US010966029B2

(12) United States Patent
Tomar

(10) Patent No.: US 10,966,029 B2
(45) Date of Patent: Mar. 30, 2021

(54) MULTI-FUNCTION TRANSDUCER ASSEMBLY AND SYSTEM

(71) Applicant: Jaguar Land Rover Limited, Coventry (GB)

(72) Inventor: Ashutosh Tomar, Coventry (GB)

(73) Assignee: JAGUAR LAND ROVER LIMITED, Coventry (GB)

( * ) Notice: Subject to any disclaimer, the term of this patent is extended or adjusted under 35 U.S.C. 154(b) by 114 days.

(21) Appl. No.: 15/757,567

(22) PCT Filed: Sep. 5, 2016

(86) PCT No.: PCT/EP2016/070877
§ 371 (c)(1),
(2) Date: Mar. 5, 2018

(87) PCT Pub. No.: WO2017/042130
PCT Pub. Date: Mar. 16, 2017

(65) Prior Publication Data

US 2019/0028813 A1 Jan. 24, 2019

(30) Foreign Application Priority Data

Sep. 7, 2015 (GB) ..... 1515812

(51) Int. Cl.
*H04R 17/00* (2006.01)
*B06B 1/06* (2006.01)
(Continued)

(52) U.S. Cl.
CPC ..... *H04R 17/005* (2013.01); *B06B 1/0622* (2013.01); *H04R 17/00* (2013.01);
(Continued)

(58) Field of Classification Search
CPC ..... H04R 17/00; H04R 2499/11; H04R 2499/15; H04R 2400/03
See application file for complete search history.

(56) References Cited

U.S. PATENT DOCUMENTS

2009/0202090 A1* 8/2009 Eaton ..... H04R 1/42 381/190
2012/0099401 A1 4/2012 Yamashita
2013/0082970 A1* 4/2013 Frey ..... G06F 3/0414 345/173

FOREIGN PATENT DOCUMENTS

EP 1 051 058 A2 11/2000
WO WO 2007/032971 A1 3/2007

OTHER PUBLICATIONS

Patents Act 1977: Combined Search and Examination Report under Sections 17 and 18(3), UKIPO Application No. GB1515812.4, dated Nov. 10, 2015, 5 pp.
(Continued)

*Primary Examiner* — Matthew A Eason
(74) *Attorney, Agent, or Firm* — Miller Nash Graham & Dunn LLP

(57) ABSTRACT

The present disclosure relates to a multi-function transducer assembly and system comprising a multi-function transducer assembly, a method of manufacturing the assembly and a method of controlling the system. The assembly includes a piezoelectric transducer layer and spaced first terminals electrically attached to the piezoelectric transducer layer. The spaced first terminals are arranged for supplying an audio frequency signal to the piezoelectric transducer layer so that the assembly can function as a speaker. Second terminals are arranged for receiving at least one signal from the piezoelectric transducer layer or supplying at least one signal to the piezoelectric transducer layer. The second
(Continued)

terminals are electrically attached to a region of the piezoelectric transducer layer between the spaced first terminals.

19 Claims, 9 Drawing Sheets

(51) Int. Cl.
*H04R 29/00* (2006.01)
*H04R 31/00* (2006.01)
*H04R 3/00* (2006.01)

(52) U.S. Cl.
CPC ..... *H04R 29/001* (2013.01); *H04R 31/00* (2013.01); *H04R 3/005* (2013.01); *H04R 31/006* (2013.01); *H04R 2499/13* (2013.01)

(56) References Cited

OTHER PUBLICATIONS

International Search Report and Written Opinion of the International Searching Authority, International Application No. PCT/EP2016/070877, dated Nov. 29, 2016, 11 pp.

* cited by examiner

MULTI-FUNCTION TRANSDUCER ASSEMBLY AND SYSTEM

RELATED APPLICATIONS

This application is a 35 U.S.C. § 371 national stage application of PCT Application No. PCT/EP2016/070877, filed on Sep. 5, 2016, which claims priority from Great Britain Patent Application No. 1515812.4, filed on Sep. 7, 2015, the contents of which are incorporated herein by reference in their entireties. The above-referenced PCT International Application was published in the English language as International Publication No. WO 2017/042130 A1 on Mar. 16, 2017.

TECHNICAL FIELD

The present disclosure relates to a multi-function transducer assembly and system. Aspects of the invention relate to a multi-function transducer assembly, a multi-function transducer system, a control panel and a vehicle including the multi-function transducer assembly, a method of manufacturing a multi-function transducer assembly and a method of controlling a multi-function transducer system.

BACKGROUND

Control panels for a vehicle are often located on the vehicle's dashboard or console. These control panels are user interfaces that provide numerous functions and include many components such as a speaker for outputting audio signals, a microphone, mechanical switches, sound system buttons and touchpads. Due to the size and number of these components, the size of a conventional multipurpose dashboard or console is undesirably large. The console or dashboard size can be reduced by moving the speaker to an alternative location, however this is often impractical as space is limited in most vehicles. Further, consoles or dashboards are the most functionally appropriate location for a speaker.

In addition to the above, control panels are often expensive to manufacture due to the cost of the components and the time required to locate and wire the these components during assembly. Such control panels are sometimes located on an underside of a vehicle's roof, or integrated into a pillar or a steering wheel. In such locations it is desirable for the control panel to be relatively light and thin especially when it is located on the underside of a vehicle's roof.

It is an object of embodiments of the invention to at least mitigate one or more of the problems of the prior art.

SUMMARY OF THE INVENTION

Aspects and embodiments of the invention provide a multi-function transducer assembly, a multi-function transducer system, a control panel, a vehicle, a method of manufacturing a multi-function transducer assembly and a method of controlling a multi-function transducer system as claimed in the appended claims.

According to an aspect of the invention there is provided a multi-function transducer assembly comprising: a piezoelectric transducer layer; at least two spaced first terminals electrically attached to the piezoelectric transducer layer and arranged for supplying an audio frequency signal to the piezoelectric transducer layer; and second terminals arranged for receiving at least one signal from the piezoelectric transducer layer or supplying at least one signal to the piezoelectric transducer layer, wherein the second terminals are electrically attached to a region of the piezoelectric transducer layer between the two spaced first terminals. Advantageously, the assembly is arranged so that the piezoelectric transducer layer can operate as a speaker by emitting audio sound waves and/or the piezoelectric transducer layer may operate as an input device by creating input signals at the second terminals. These input signals may be caused by distortions in the piezoelectric transducer layer from strokes or taps by a finger or stylus on the piezoelectric transducer layer.

The multi-function transducer may comprise electrically conductive runners electrically coupled to a respective one of the second terminals, wherein the electrically conductive runners are electrically insulated from the piezoelectric transducer layer. This therefore provides a cost effective and efficient interconnection assembly and prevents electrical shorting of areas of the piezoelectric transducer layer.

Suitably, the two spaced first terminals may be electrically attached to respective peripheral regions of the piezoelectric transducer layer. This therefore allows for a speaker function that utilises the area of the piezoelectric transducer layer.

The second terminals may include a group of at least three said second terminals arranged to define a pressure sensitive touch pad region of the piezoelectric transducer layer. This therefore increases the functionality of the assembly.

The group may comprise more than three of said second terminals and wherein the group forms an array on the piezoelectric transducer layer. This therefore improves the sensitivity and number of stroke patterns that may be detected by the pressure sensitive touch pad region.

Suitably, two of the said second terminals may be switch terminals arranged to define a switch region of the piezoelectric transducer layer, wherein the switch region is arranged to generate a switch signal across the switch terminals in response to pressure applied to the switch region. This therefore increases the functionality of the assembly.

Two of the said second terminals may be slider terminals arranged to define a slider function region of the piezoelectric transducer layer, wherein the slider function region is arranged to generate a variable voltage signal across the slider terminals in response to pressure applied at different locations on the slider function region. This therefore increases the functionality of the assembly.

Two of said second terminals may be microphone terminals arranged to define a microphone region of the piezoelectric transducer layer, wherein the microphone region is arranged to generate audio frequency signals across microphone terminals in response to sound waves deforming the microphone region. This therefore increases the functionality of the assembly.

The piezoelectric transducer layer may comprise ceramic piezoelectric crystals. Such crystals advantageously have good thermal stability and piezoelectric parameters suitable for generating sound waves generating electrical signals.

The electrically conductive runners may be formed in a foldable insulating membrane. This allows the assembly to be folded or bent into numerous shapes.

The foldable insulating membrane may be an insulating substrate of a circuit board. This allows for easy attachment of electronic components to the assembly.

Suitably, the two spaced first terminals or at least some of the second terminals may be arranged to generate ultrasonic signals and/or detect ultrasonic signals. This advantageously allows for providing an ultrasonic security feature and/or contactless gesture detection.

According to another aspect of the invention there is provided a multi-function transducer system comprising the multi-function transducer assembly as described above, wherein the system includes speaker driving circuitry coupled to the spaced first terminals. This speaker driving circuitry advantageously allows the piezoelectric transducer layer to operate as a speaker by emitting audio sound waves.

Suitably, the system may include signal processing circuitry coupled to at least two of the second terminals. This advantageously allows the piezoelectric transducer layer to operate as an input device by creating input signals at the second terminals.

There may be haptic feedback driving circuitry coupled to at least two of the second terminals. The haptic feedback driving circuitry provides a tactile feedback signal in response to the input signals.

The system may be arranged to control the speaker driving circuitry to selectively supply an audio signal to the spaced first terminals to thereby vibrate the piezoelectric transducer layer and emit audio waves. Hence, when the supply of the audio signal to the spaced first terminals is terminated the assembly can function solely as an input device.

Suitably, there may be signal processing circuitry arranged to process voltages received from at least two of the second terminals in response to a distortion of the piezoelectric transducer layer by a mechanical force applied thereto. This therefore increases the functionality of the system.

The haptic feedback driving circuitry may be arranged to supply a signal to at least some of the second terminals to thereby distort the piezoelectric transducer layer to provide a haptic feedback function. This therefore increases the functionality of the system.

There may be ultrasonic driving circuitry for providing an ultrasonic signal to the two spaced first terminals or at least some of the second terminals. There may also be ultrasonic receiving and processing circuitry for detecting ultrasonic signals received due to distortions in the piezoelectric transducer layer. The processing circuitry may include gesture recognition processing means for determining specific gestures from ultrasonic signals due to distortions in the piezoelectric transducer layer. This advantageously allows for providing an ultrasonic security feature and/or contactless gesture detection.

According to yet a further aspect of the invention there is provided a control panel comprising the multi-function transducer assembly as described above.

According to an even further aspect of the invention there is provided a vehicle comprising the multi-function transducer assembly as described above.

According to yet another further aspect of the invention there is provided a method of manufacturing a multi-function transducer assembly, the method comprising:

providing a substrate comprising at least two spaced first terminals and at least two second terminals; and electrically attaching to a piezoelectric transducer layer the at least two spaced first terminals and the at least two second terminals, wherein the second terminals are electrically attached to a region of the piezoelectric transducer layer between the two spaced first terminals. This therefore provides an efficient method of manufacturing a multi-function transducer assembly.

The electrically attaching may be characterised in that the spaced first terminals are electrically attached to respective peripheral regions of the piezoelectric transducer layer. This therefore allows for a speaker function that utilises the area of the piezoelectric transducer layer.

The substrate may include electrically conductive runners electrically coupled to a respective one of the second terminals, wherein the electrically conductive runners are electrically insulated from the piezoelectric transducer layer. This therefore provides a cost effective and efficient interconnection assembly and prevents electrical shorting of areas of the piezoelectric transducer layer.

Suitably, the electrically attaching may include: depositing the piezoelectric transducer layer as a piezoelectric ink onto the substrate to thereby cover the two spaced first terminals and the two second terminals; and curing the piezoelectric ink to form the piezoelectric transducer layer. This is a relatively fast an economical process of attaching the piezoelectric transducer layer to the spaced first terminals and second terminals.

The electrically attaching may include: depositing the piezoelectric transducer layer as a piezoelectric ink onto a mounting sheet; curing the piezoelectric ink to form the piezoelectric transducer layer; and bonding the piezoelectric transducer layer to the at least two spaced first terminals and the at least two second terminals. This also is a relatively fast an economical process of attaching the piezoelectric transducer layer to the spaced first terminals and second terminals.

According to yet another aspect of the invention there is provided method of controlling the multi-function transducer system as described above, the method comprising:

controlling the speaker driving circuitry to supply a speaker signal to the spaced first terminals to thereby cause the piezoelectric transducer layer to operate as a speaker by emitting audio sound waves;

detecting a terminating signal at a region of the piezoelectric transducer layer between at least two of the second terminals, wherein the termination signal is caused by a mechanical force applied to the region of the piezoelectric transducer layer; and controlling the speaker driving circuitry to terminate the supply of the speaker signal in response to detecting of the terminating signal. This advantageously allows the piezoelectric transducer layer to operate solely as an input device upon detection of the terminating signal.

The detecting may include: monitoring a voltage level across the least two of the second terminals; and determining an occurrence of the terminating signal when the voltage level exceed a voltage threshold value. This therefore allows the piezoelectric transducer layer to concurrently operate as both an input device and speaker.

Suitably, upon the termination of the supplying of the speaker signal, the method may process one or more input signals caused by distortions in the piezoelectric transducer layer. The piezoelectric transducer layer thereby operates an input device with multiple possible input regions.

The processing may include creating an audio signal from at least one of the input signals. This advantageously allows a region of the piezoelectric transducer layer to operate as a microphone.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Embodiments of the invention will now be described by way of example only, with reference to the accompanying figures, in which.

DETAILED DESCRIPTION

Figure 1:
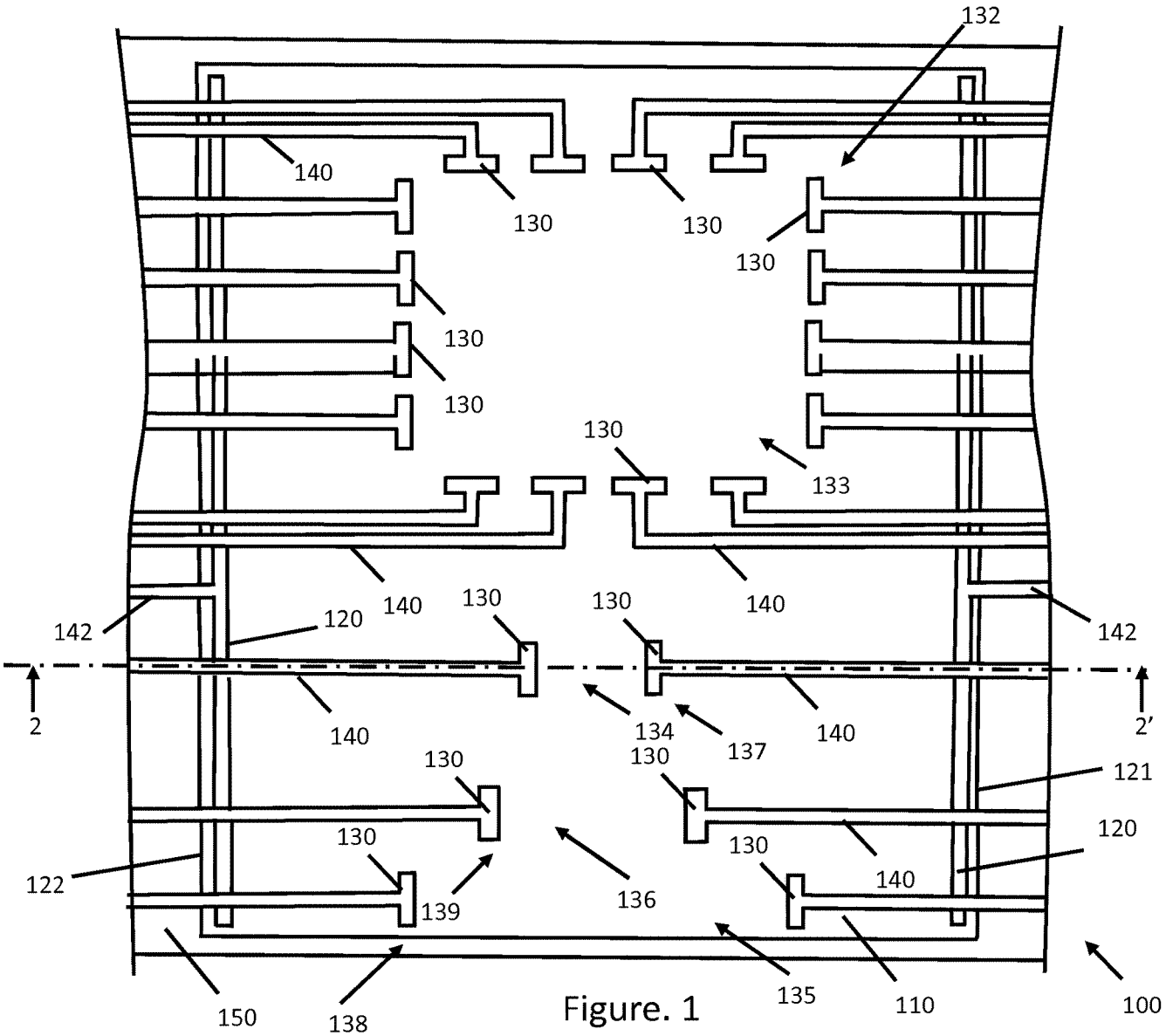
FIG. 1 is a plan view of a multi-function transducer assembly according to an embodiment of the invention.

FIG. 1 is a plan view of a multi-function transducer assembly 100 according to an embodiment of the invention. The multi-function transducer assembly 100 comprises a piezoelectric transducer layer 110 typically comprising ceramic piezoelectric crystals. There are two spaced first terminals 120 electrically attached to the piezoelectric transducer layer 110. The two spaced first terminals 120 are arranged for supplying an audio frequency signal to the piezoelectric transducer layer 110. In this embodiment, the two spaced first terminals 120 are electrically attached to respective peripheral regions 121, 122 adjacent opposite edges of the piezoelectric transducer layer 110. As shown in this embodiment each of the two spaced first terminals 120 are elongate and extend substantially along a full length a respective edge 121 or 122 of piezoelectric transducer layer 110. There are also second terminals 130 arranged for receiving at least one signal from the piezoelectric transducer layer 110 or supplying at least one signal to the piezoelectric transducer layer 110. As illustrated in this embodiment, all of the second terminals 130 are electrically attached to a region of the piezoelectric transducer layer 110 between the spaced first terminals 120.

In this embodiment, the multi-function transducer assembly 100 includes electrically conductive runners 140 located on the piezoelectric transducer layer 110. The electrically conductive runners 140 are electrically coupled to a respective one of the second terminals 130. To prevent electrical shorting of areas of the piezoelectric transducer layer 110, the electrically conductive runners 140 are electrically insulated from the piezoelectric transducer layer 110. There are also further electrically conductive runners 142 electrically coupled to a respective one of the two spaced first terminals 120.

As shown in this embodiment, the second terminals 130 include a group of second terminals 132 that are arranged to define a pressure sensitive touch pad region 133 of the piezoelectric transducer layer 110. This pressure sensitive touch pad region 133 is arranged to generate command signals in response to pressure patterns applied as stokes or taps by a finger or stylus as will be apparent to a person skilled in the art. The group of second terminals 132 may include three or more second terminals 130, and as shown in this embodiment, the group of second terminals 132 includes sixteen second terminals 130 that form an array on the piezoelectric transducer layer 110. In this illustrated embodiment, two of the second terminals 130 are switch terminals 137 arranged to define a switch region 134 of the piezoelectric transducer layer 110. This switch region 134 is arranged to generate a switch signal across the switch terminals 137 in response to pressure applied (for example by a finger) to the switch region 134.

In this embodiment, two of the second terminals 130 are slider terminals 138 arranged to define a slider function region 135 of the piezoelectric transducer layer 110. The slider function region 135 is arranged to generate a variable voltage signal across the slider terminals 138 in response to pressure applied (for example by a finger) at different locations on the slider function region 135. Also, in this embodiment two of the second terminals 130 are microphone terminals 139 arranged to define a microphone region 136 of the piezoelectric transducer layer 110. The microphone region 136 is arranged to generate audio frequency signals across microphone terminals 139 in response to sound waves deforming in the microphone region 136.

As shown in this embodiment, the electrically conductive runners 140, and the further electrically conductive runners 142 are formed in an insulating membrane 150. The insulating membrane 150 which is typically a foldable membrane sheet and forms an insulating substrate of a circuit board as will be apparent to a person skilled in the art.

In other embodiments the two spaced first terminals 120 or at least some of the second terminals 130 may be arranged to generate ultrasonic signals and/or detect ultrasonic signals.

Figure 2:
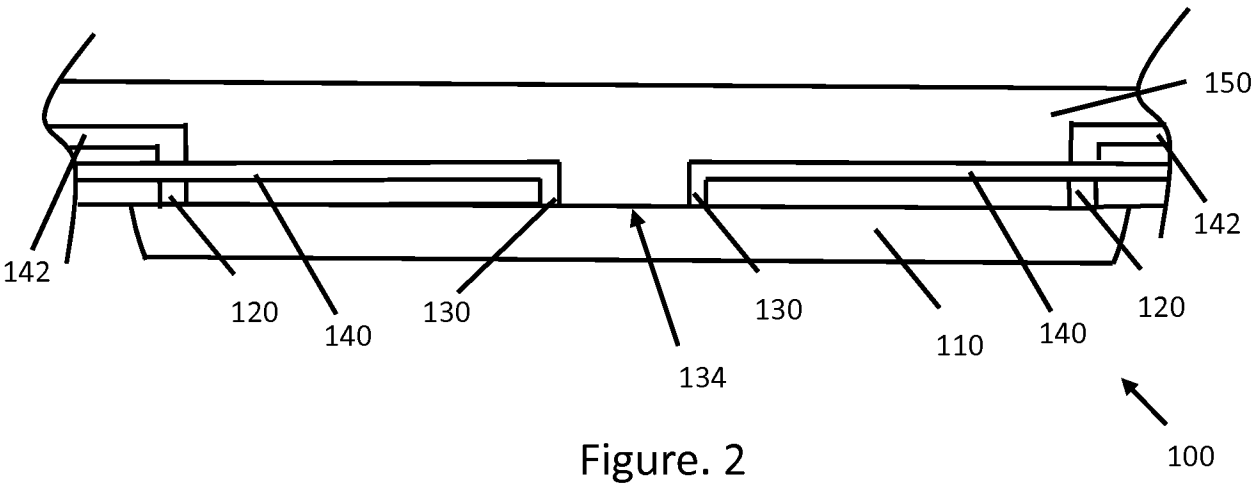
FIG. 2 is a cross sectional side view through 2-2' of the multi-function transducer assembly of FIG. 1.

Referring to FIG. 2 there is illustrated a cross sectional side view through 2-2' of the multi-function transducer assembly 100 shown in FIG. 1. In this embodiment the insulating membrane 150 is transparent and the piezoelectric transducer layer 110 is a film deposited onto the insulating membrane 150.

Figure 3:
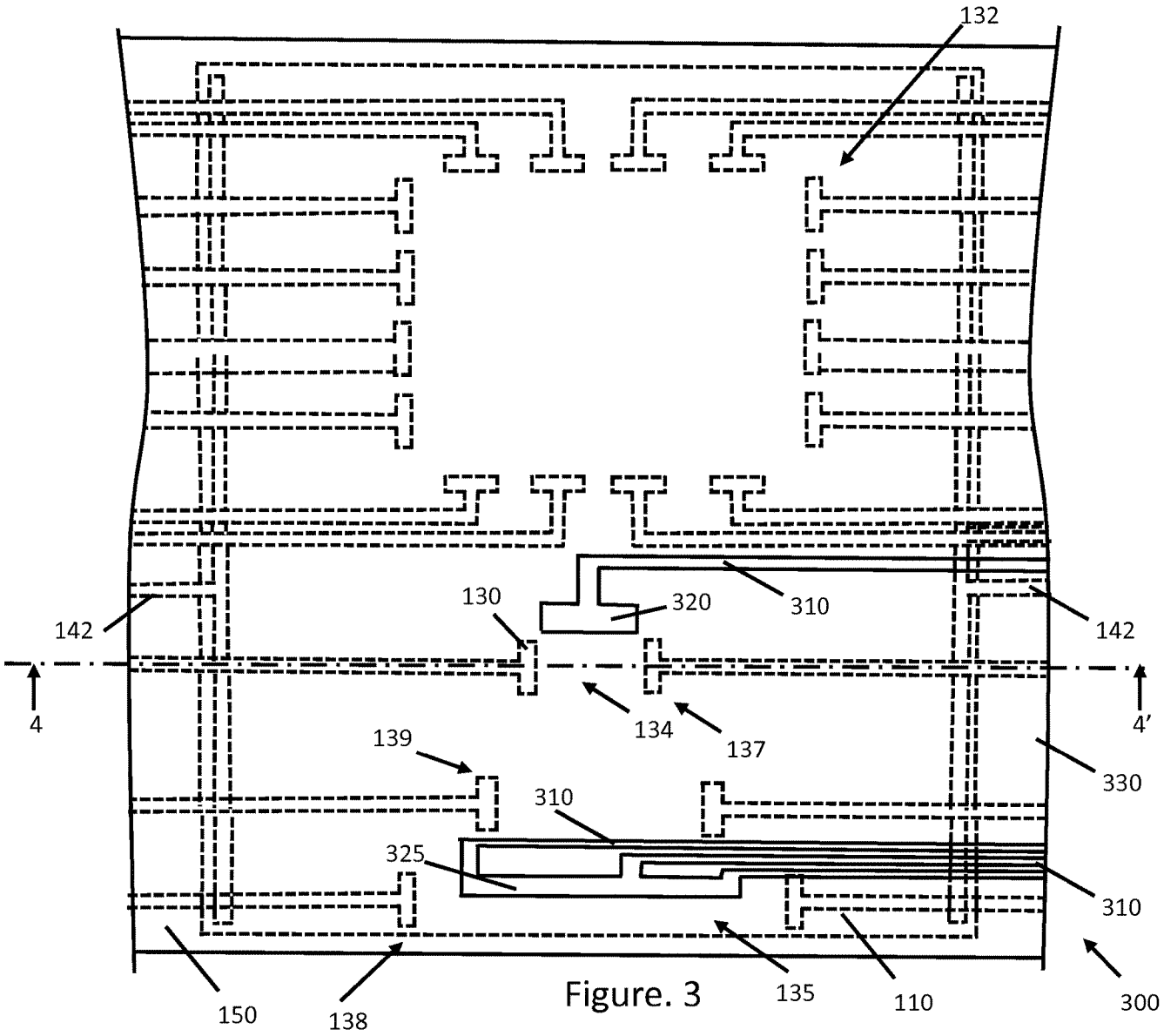
FIG. 3 is a plan view of a multi-function transducer assembly, according to another embodiment of the invention.

In FIG. 3 there is illustrated a plan view of multi-function transducer assembly 300, according to another embodiment of the invention. The multi-function transducer assembly 300 includes all of the components, structure and features of the multi-function transducer assembly 100 and therefore to avoid repetition only the additional components, structure and features are described. In this embodiment, the multi-function transducer assembly 300 includes light guides 310 coupled to respective light dispersal regions 320, 325. The light guides 310 are arranged to couple their respective light dispersal regions 320, 325 to one or more light sources (not shown). The light guides 310 and light dispersal regions 320, 325 are typically integrated into a foldable sheet 330. The foldable sheet 330 is supported on the insulating membrane 150 and the light dispersal regions 320, 325 are located strategically near selected one or more of the second terminals 130. In this embodiment, the light dispersal region 320 is located proximal to the switch region 134 and the light dispersal region 325 is located proximal to the slider function region 135.

Figure 4:
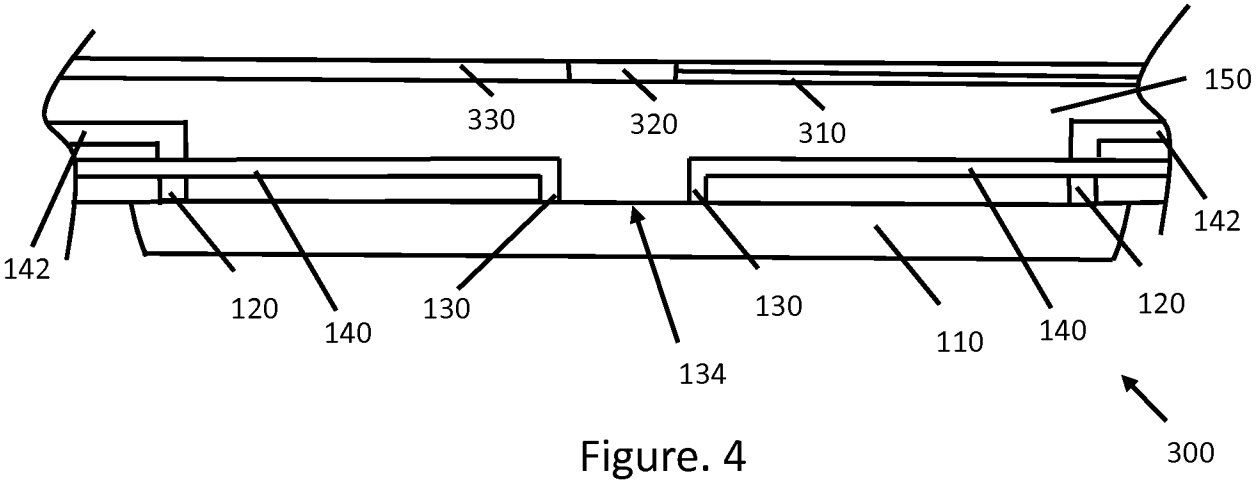
FIG. 4 is a cross sectional side view through 4-4' of the multi-function transducer assembly of FIG. 3.

Referring to FIG. 4 there is illustrated a cross sectional side view through 4-4' of the multi-function transducer assembly 300. In this embodiment the foldable sheet 330 is fixed directly to the membrane 150 by a suitable adhesive such as an epoxy resin.

Figure 5:
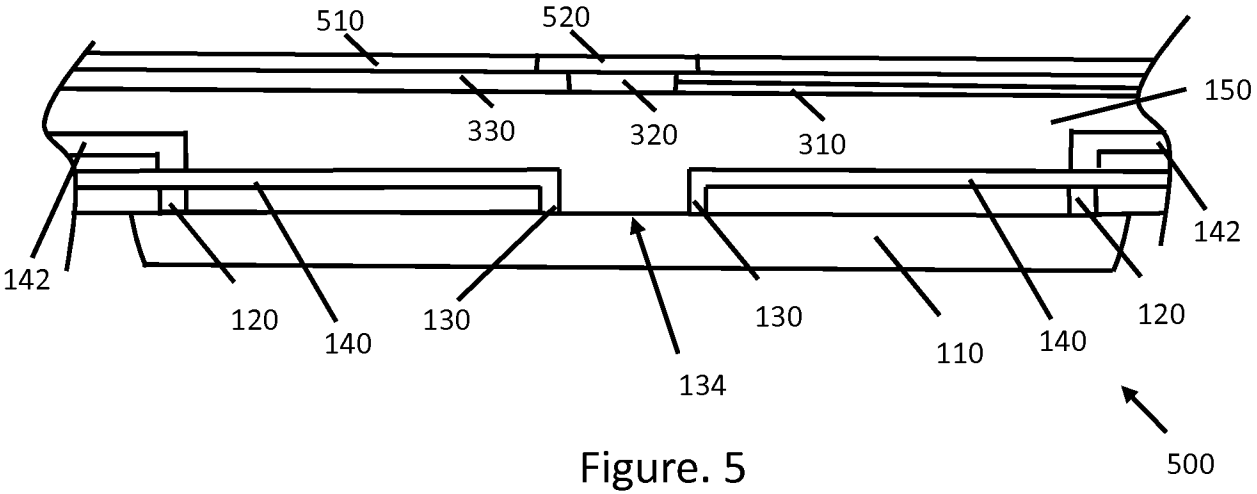
FIG. 5 is a cross sectional side of a multi-function transducer assembly, according to another embodiment of the invention.

In FIG. 5 there is illustrated a plan view of multi-function transducer assembly 500, according to another embodiment of the invention. The multi-function transducer assembly 500 includes all of the components, structure and features of the multi-function transducer assembly 300 and therefore to avoid repetition only the additional components, structure and features are described. As shown the multi-function transducer assembly 500 includes a covering layer or film 510 that is typically opaque with transparent or translucent window regions, such as a window 420, for allowing viewing of the dispersal region 320 and a similar widow (not shown) allows for viewing of the dispersal region 325. Optionally, the widows such as window 420 may be arranged to diffuse light as will be apparent to a person skilled in the art.

Figure 6:
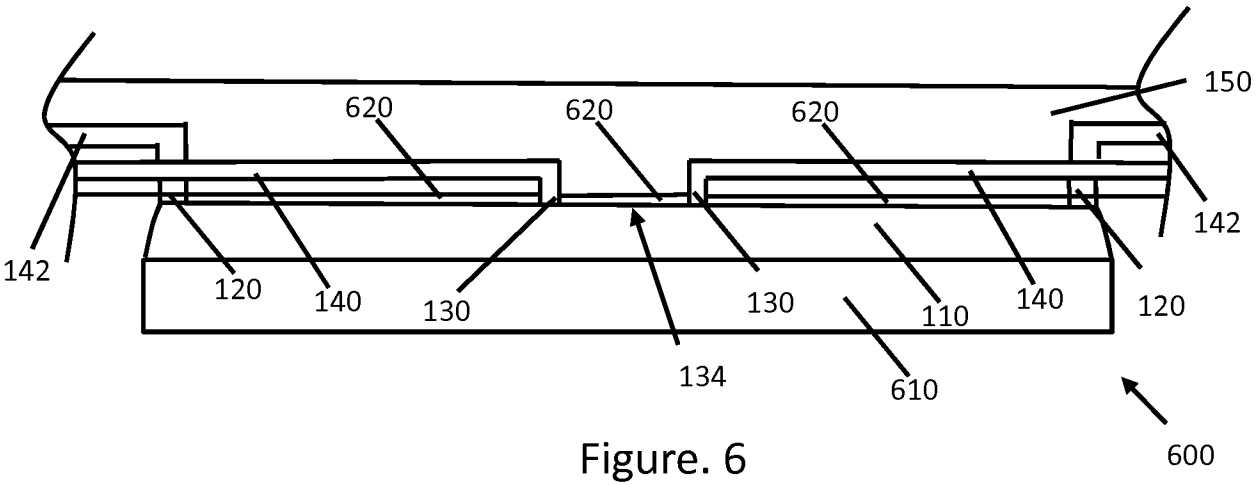
FIG. 6 is a cross sectional side of a multi-function transducer assembly, according to another embodiment of the invention.

Referring to FIG. 6 there is illustrated a cross sectional side of a multi-function transducer assembly 600, according to another embodiment of the invention. This embodiment is a cross sectional view through 2-2' of a modified version of the multi-function transducer assembly 100 in which the piezoelectric transducer layer 110 is a film deposited a mounting sheet 610. An adhesive layer 620 attaches the piezoelectric transducer layer 110 to the insulating membrane 150, and the spaced first terminals 120 and the second terminals 130 are electrically attached to the piezoelectric transducer layer 110 by conductive adhesive bonds or by solder bonds.

As will be apparent to a person skilled in the art, the embodiments of the multi-function transducer assemblies 300, 400 and 500 may be modified to include the embodiment of the piezoelectric transducer layer 110 shown in FIG. 6 and described above.

Figure 7:
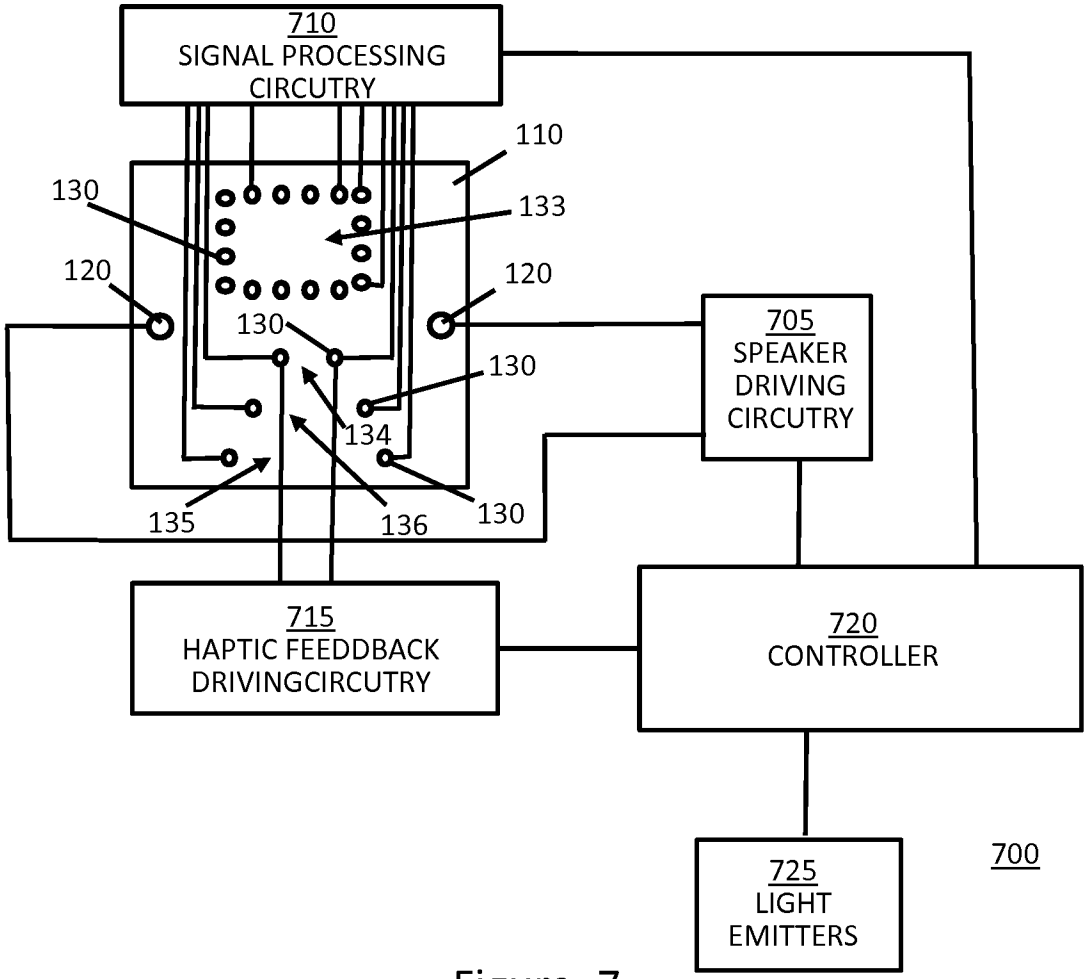
FIG. 7 is a schematic circuit diagram of a multifunction transducer system according to an embodiment of the invention.

Referring to FIG. 7 there is illustrated a schematic circuit diagram of a multifunction transducer system 700 according to an embodiment of the invention. The system 700 may include any of the above embodiments of the multi-function transducer assembly 100, 300, 500 or 600. The system 700 includes speaker driving circuitry 705 coupled to the spaced first terminals 120. There is also signal processing circuitry 710 coupled to at least two of the second terminals 130, and in this embodiment the signal processing circuitry 710 is coupled to all of the second terminals 130. The system 700 in this embodiment includes haptic feedback driving circuitry 715 coupled to at least two of the second terminals 130 such as the switch terminals 137 that define the switch region 134. The system 700 also includes a controller means in the form of a controller 720 that is arranged to process signals received from the signal processing circuitry 710 and send control signals to the speaker driving circuitry 705 and haptic feedback driving circuitry 715. In this embodiment the system 700 includes a light emitting means in the form of light emitters 725 that are typically light emitting diodes. The controller 720 is arranged to selectively control the light emitters 725 which are located to emit light into the light guides 310 for supplying the light dispersal regions 320, 325.

In this embodiment the speaker driving circuitry 705 is arranged to supply an audio signal to the spaced first terminals 120 to thereby vibrate the piezoelectric transducer layer 110 to provide a speaker function by emitting audio waves. Also, the signal processing circuitry 705 is arranged to process voltages received from at least two of the second terminals 130 in response to a distortion of the piezoelectric transducer layer 110 by a mechanical force applied thereto. Thus, if a force is applied the switch region 134 a voltage (the switch signal) will be generated across the switch terminals 137. Furthermore, the haptic feedback driving circuitry 615 is arranged to supply a signal to at least some of the second terminals 130, such the switch terminals 130 that define the switch region 134, to thereby distort the piezoelectric transducer layer 110 to provide a haptic feedback function.

In one embodiment the transducer system 700 may include ultrasonic driving circuitry for providing an ultrasonic signal to the two spaced first terminals 120 or at least some of the second terminals 130. There may also be ultrasonic receiving and processing circuitry for detecting ultrasonic signals received due to distortions in the piezoelectric transducer layer. The ultrasonic processing circuitry may be integrated into the signal processing circuitry 710 and may include gesture recognition processing means for determining specific gestures from ultrasonic signals due to distortions in the piezoelectric transducer layer. The ultrasonic processing circuitry may also be a separate module and the system 700 may be arranged to multiplex the ultrasonic signals to the ultrasonic processing circuitry via the paced first terminals 120 or at least some of the second terminals 130. The ultrasonic driving circuitry may be integrated into the speaker driving circuitry 705 or it may also be a separate module. The system 700 may be arranged to multiplex the ultrasonic signals from the ultrasonic driving circuitry via the paced first terminals 120 or at least some of the second terminals 130.

Figure 8:
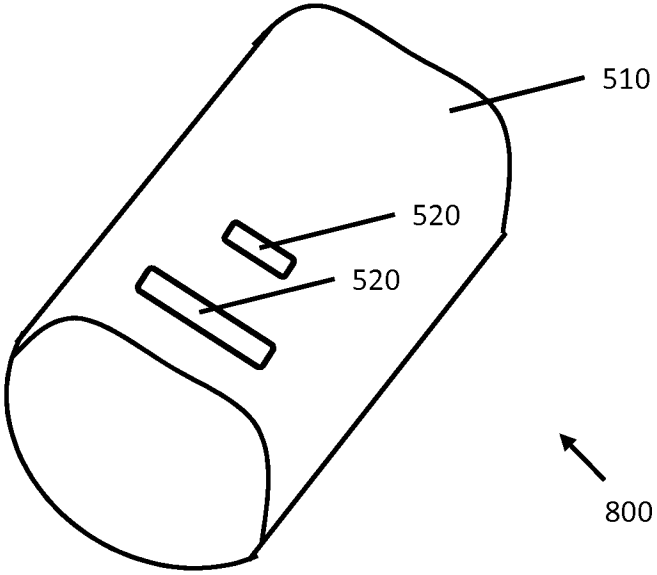
FIG. 8 is a perspective view of a control panel according to an embodiment of the invention.

Referring to FIG. 8 there is illustrated a perspective view of a control panel 800 according to an embodiment of the invention. The control panel 800 comprises any one of the multi-function transducer assemblies 100, 300, 500 and 600. Optionally, the control panel 800 has an outer surface provided by the film 510. As shown in this embodiment, the film 510 includes the windows 520 for viewing of the dispersal region 325 so that light emitted from the light emitters 625 can be displayed by the control panel 800.

Figure 9:
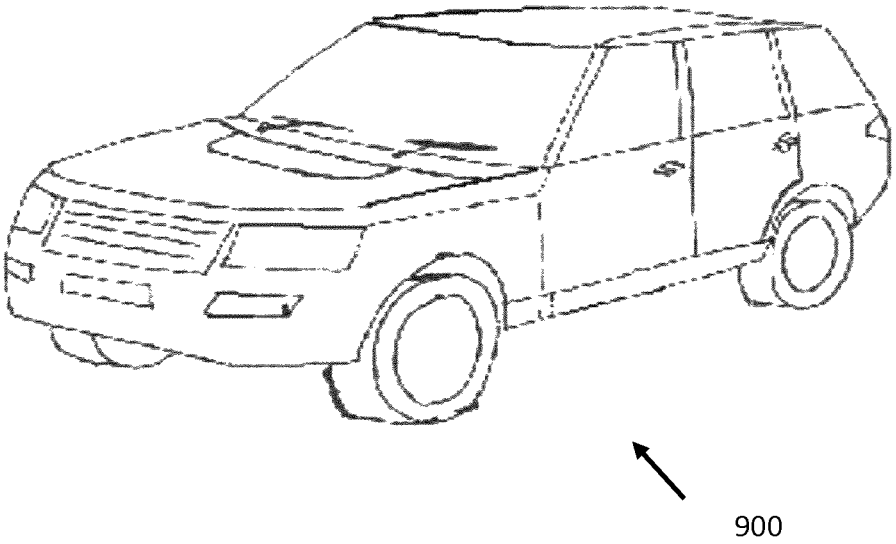
FIG. 9 is a perspective view of a vehicle according to an embodiment of the invention.

Referring to FIG. 9 there is illustrated a perspective view of vehicle 900 comprising any of the multi-function transducer assemblies 100, 300, 500 and 600 according to an embodiment of the invention.

Figure 10:
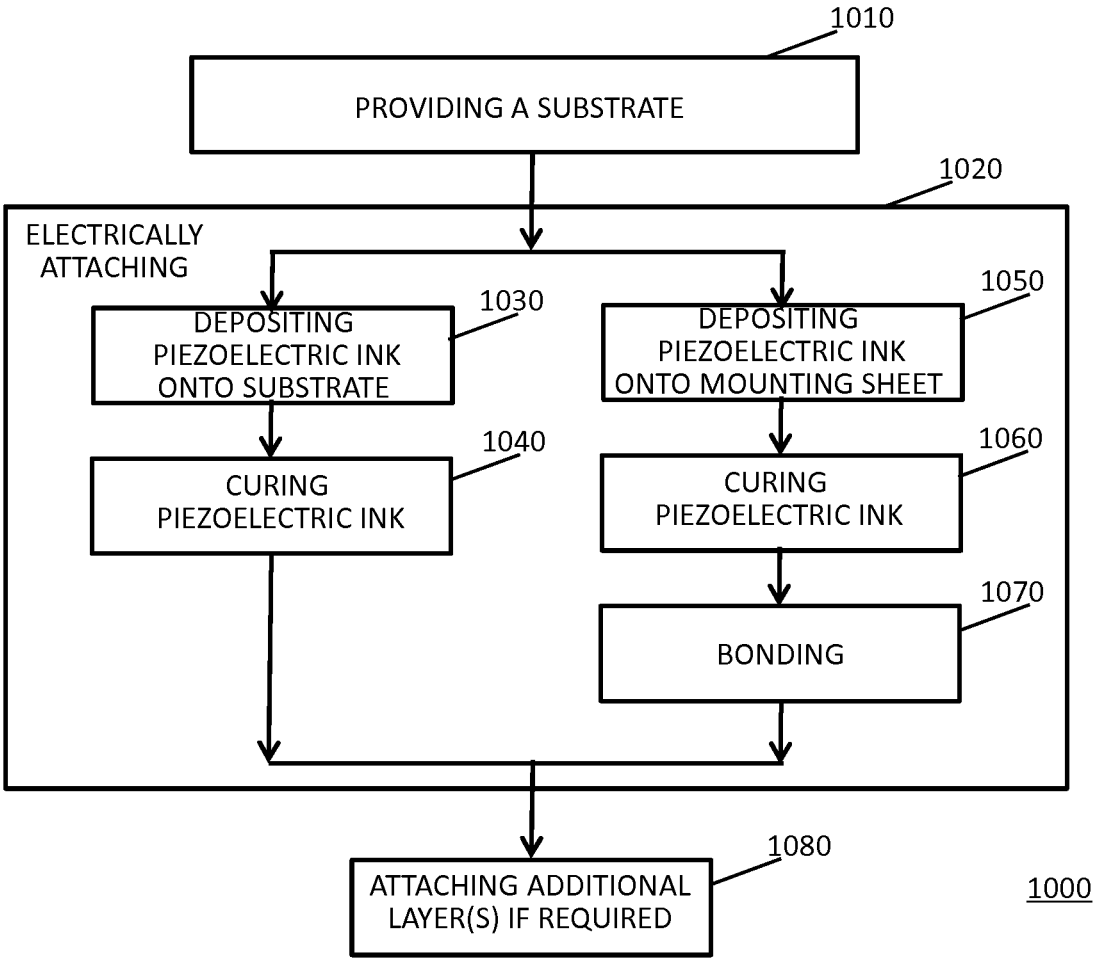
FIG. 10 shows a flow chart illustrating of a method of manufacturing a multi-function transducer assembly according to an embodiment of the invention.

In FIG. 10 there is a flow chart illustrating of a method 1000 of manufacturing a multi-function transducer assembly according to an embodiment of the invention. By way of illustration only the method 1000 will be described, where appropriate, with reference to the multi-function transducer assemblies 100, 300, 500 and 600. The method 1000 includes a step 1010 of providing a substrate which in this embodiment is the insulating membrane 150 comprising the at least two spaced first terminals 120 and the at least two second terminals 130. Also in this embodiment the substrate (the insulating membrane 150) includes the electrically conductive runners 140 electrically coupled to a respective one of the second terminals 130. As mentioned above, the electrically conductive runners 140 are electrically insulated from the piezoelectric transducer layer 110.

At an attaching step 1020 there is performed a process of electrically attaching to the piezoelectric transducer layer 110 the at least two spaced first terminals 120 and the at least two second terminals 130. When so attached the second terminals are electrically attached to a region of the piezoelectric transducer layer 110 between the two spaced first terminals 120. The electrically attaching may be characterised in that the spaced first terminals 120 are electrically attached to respective peripheral regions of the piezoelectric transducer layer 110. In one embodiment the attaching step 1020 includes a step 1030 of depositing the piezoelectric transducer layer 110 as a piezoelectric ink onto the substrate to thereby cover the two spaced first terminals 120 and the two second terminals 130. After completion of step 1030, the method 1000 performs a curing process at a step 1040 to cure the piezoelectric ink to thereby form the piezoelectric transducer layer 110.

In another embodiment the attaching step 1020 includes a step 1050 of depositing the piezoelectric transducer layer 110 as a piezoelectric ink onto the mounting sheet 610. After completion of step 1050, the method 1000 performs a curing process at a step 1060 to cure the piezoelectric ink to thereby form the piezoelectric transducer layer 110. Next at a bonding step 1070 there is performed a process of bonding the piezoelectric transducer layer 110 to the at least two spaced first terminals 120 and the at least two second terminals 130 typically by a conductive adhesive or by a solder bonding.

After the attaching step 1020 an optional step 180 of attaching additional layers may be performed to complete the manufacturing the multi-function transducer assembly 100, 300, 500 or 600. These layers include: the foldable sheet 330 with the light guides 310 and their respective light dispersal regions 320, 325; and the covering layer or film 510 with the transparent or translucent window regions.

Figure 11:
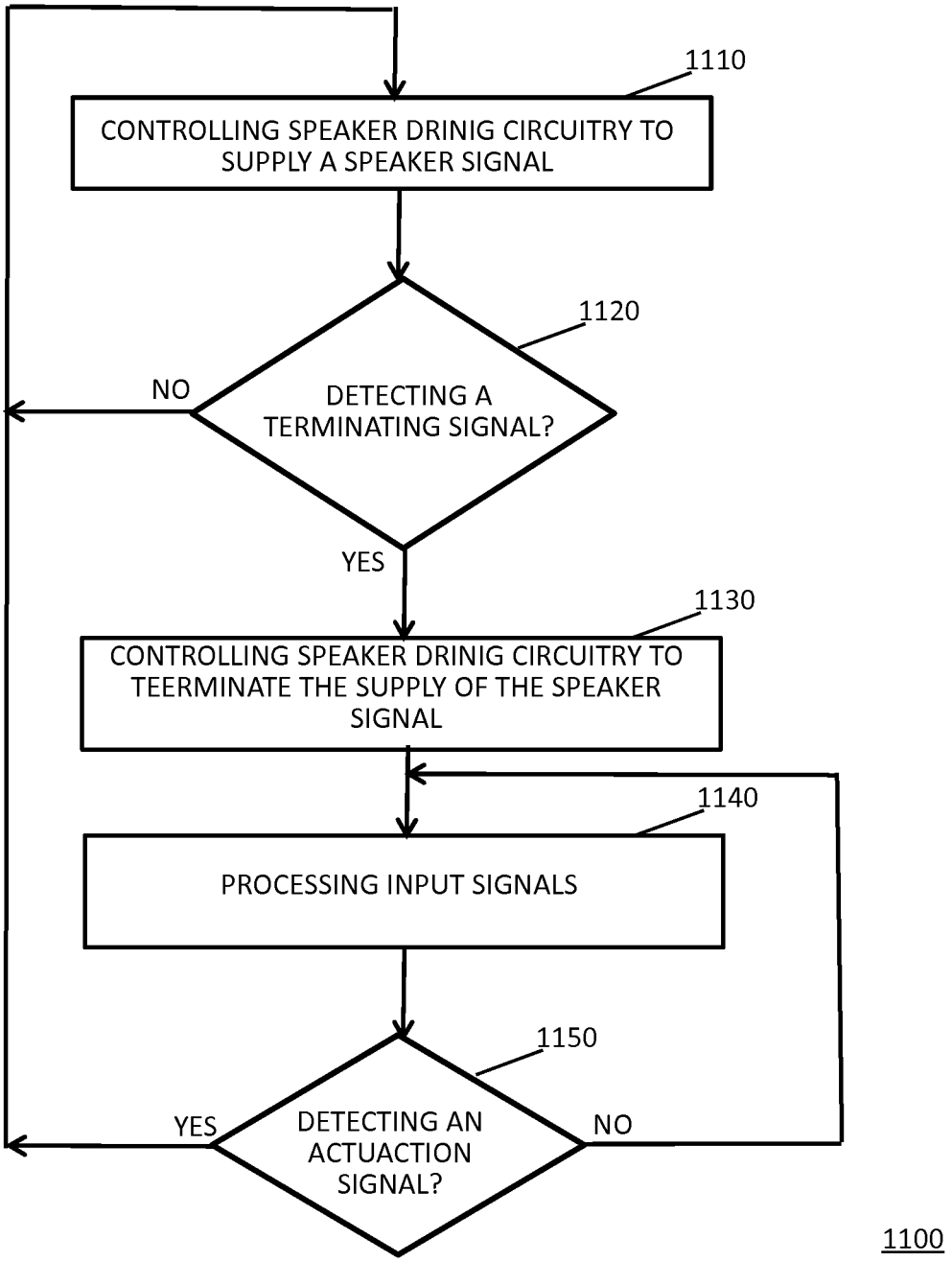
FIG. 11 shows a flow chart illustrating of a method of controlling a multi-function transducer system according to an embodiment of the invention.

In FIG. 11 a flow chart illustrates a method 1100 of controlling the multi-function transducer system 700 according to an embodiment of the invention. At a step 1110 there is performed a process of controlling the speaker driving circuitry 705 to supply a speaker signal to the spaced first terminals 120 to thereby cause the piezoelectric transducer layer 110 to operate as a speaker by emitting audio sound waves. At a detecting decision step 1120 the method 1100 determines if a terminating signal at a region of the piezoelectric transducer layer 110 between at least two of the second terminals 130 has been detected. This termination signal is caused by a mechanical force applied to the region of the piezoelectric transducer layer 110 (for example the switch region 134, or any of the other regions 133, 235 or 136). If the terminating signal is not detected then step 110 is repeated. However if the terminating signal is detected at the detecting decision step 1120 a controlling step 1130 is performed. In one embodiment the detecting decision step 1120 includes monitoring a voltage level across the least two of the second terminals 130 and determining an occurrence of the terminating signal when the voltage level exceeds a voltage threshold value. This therefore allows the piezoelectric transducer layer 110 to concurrently operate as both an input device and speaker until the voltage level exceeds a voltage threshold value.

At the controlling step 1130 there is performed a process of controlling the speaker driving circuitry 705 to terminate the supply of the speaker signal to the spaced first terminals 120. This termination of the speaker signal is in response to the detecting of the terminating signal and at a processing step 1140 processing of one or more input signals caused by distortions in the piezoelectric transducer layer 110 is performed. Such processing includes processing signals generated for example in the switch region 134, or any of the other regions 133, 235 or 136. At a detecting decision step 1150 the method 1100 determines if an actuation signal at a region of the piezoelectric transducer layer 110 between at least two of the second terminals 130 has been detected. If the actuation signal has not been detected the processing step 1140 is repeated. However, if the actuation signal is detected then the step 1110 is repeated and the speaker driving circuitry 705 again supplies the speaker signal to the spaced first terminals. In one embodiment the method 1100 is controlled by the controller 720. However, in other embodiment the method may be controlled by a plurality of controllers and processing circuitry as will be apparent to a person skilled in the art.

It will be appreciated that embodiments of the present invention can be realised in the form of hardware, software or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of machine-readable storage that are suitable for storing a program or programs that, when executed, implement embodiments of the present invention. Accordingly, embodiments provide a program comprising code for implementing a system, assembly or method as claimed in any preceding claim and a machine readable storage storing such a program. Still further, embodiments of the present invention may be conveyed electronically via any medium such as a communication signal carried over a wired or wireless connection and embodiments suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed. The claims should not be construed to cover merely the foregoing embodiments, but also any embodiments which fall within the scope of the claims.

The invention claimed is:

1. A multi-function transducer assembly, comprising: a piezoelectric transducer layer;

at least two spaced first terminals electrically attached to the piezoelectric transducer layer and arranged for supplying an audio frequency signal to the piezoelectric transducer layer; and second terminals arranged for receiving at least one signal from the piezoelectric transducer layer or supplying at least one signal to the piezoelectric transducer layer, wherein the second terminals are electrically attached to a region of the piezoelectric transducer layer between the at least two spaced first terminals.

2. The multi-function transducer assembly of claim 1, further comprising electrically conductive runners electrically coupled to a respective one of the second terminals, wherein the electrically conductive runners are electrically insulated from the piezoelectric transducer layer.

3. The multi-function transducer assembly of claim 1, wherein the at least two spaced first terminals are electrically attached to respective peripheral regions of the piezoelectric transducer layer.

4. The multi-function transducer assembly of claim 1, wherein the second terminals include a group of at least three second terminals arranged to define a pressure sensitive touch pad region of the piezoelectric transducer layer.

5. The multi-function transducer assembly of claim 4, wherein the group comprises more than three of second terminals and wherein the group forms an array on the piezoelectric transducer layer.

6. The multi-function transducer assembly of claim 1, wherein two of the second terminals are:

switch terminals arranged to define a switch region of the piezoelectric transducer layer, wherein the switch region is arranged to generate a switch signal across the switch terminals in response to pressure applied to the switch region; and/or slider terminals arranged to define a slider function region of the piezoelectric transducer layer, wherein the slider function region is arranged to generate a variable voltage signal across the slider terminals in response to pressure applied at different locations on the slider function region; and/or microphone terminals arranged to define a microphone region of the piezoelectric transducer layer, wherein the microphone region is arranged to generate audio frequency signals across microphone terminals in response to sound waves deforming the microphone region.

7. The multi-function transducer assembly of claim 2, wherein the electrically conductive runners are formed in a foldable insulating membrane.

8. The multi-function transducer assembly of claim 7, wherein the foldable insulating membrane is an insulating substrate of a circuit board.

9. A multi-function transducer system, comprising: the multi-function transducer assembly of claim 1, wherein the system includes speaker driving circuitry coupled to the at least two spaced first terminals, and wherein the system is arranged to control the speaker driving circuitry to selectively supply an audio signal to the at least two spaced first terminals to thereby vibrate the piezoelectric transducer layer and emit audio waves; and/or wherein the system includes signal processing circuitry coupled to at least two of the second terminals and wherein the system is arranged to process voltages received from at least two of the second terminals in response to a distortion of the piezoelectric transducer layer by a mechanical force applied thereto; and/or wherein the system includes haptic feedback driving circuitry coupled to at least two of the second terminals and wherein the system is arranged to supply a signal to at least some of the second terminals to thereby distort the piezoelectric transducer layer to provide a haptic feedback function.

10. A control panel comprising the multi-function transducer assembly of claim 1.

11. A vehicle comprising the multi-function transducer assembly of claim 1.

12. A method of manufacturing a multi-function transducer assembly, the method comprising:

providing a substrate comprising at least two spaced first terminals and at least two second terminals; and electrically attaching to a piezoelectric transducer layer the at least two spaced first terminals and the at least two second terminals, wherein the second terminals are electrically attached to a region of the piezoelectric transducer layer between the at least two spaced first terminals, wherein the substrate includes electrically conductive runners electrically coupled to a respective one of the at least two second terminals, and wherein the electrically conductive runners are electrically insulated from the piezoelectric transducer layer.

13. The method of claim 12, wherein the electrically attaching is characterised in that the at least two spaced first terminals are electrically attached to respective peripheral regions of the piezoelectric transducer layer.

14. The method of claim 12, wherein the electrically attaching includes:

depositing the piezoelectric transducer layer as a piezoelectric ink onto the substrate to thereby cover the at least two spaced first terminals and the at least two second terminals; and curing the piezoelectric ink to form the piezoelectric transducer layer.

15. The method of claim 12, wherein the electrically attaching comprises:

depositing the piezoelectric transducer layer as a piezoelectric ink onto a mounting sheet;

curing the piezoelectric ink to form the piezoelectric transducer layer; and bonding the piezoelectric transducer layer to the at least two spaced first terminals and the at least two second terminals.

16. A method of controlling the multi-function transducer system as claimed in claim 12, the method comprising:

controlling the speaker driving circuitry to supply a speaker signal to the at least two spaced first terminals to thereby cause the piezoelectric transducer layer to operate as a speaker by emitting audio sound waves;

detecting a terminating signal at a region of the piezoelectric transducer layer between at least two of the second terminals, wherein the termination signal is caused by a mechanical force applied to the region of the piezoelectric transducer layer; and controlling the speaker driving circuitry to terminate the supply of the speaker signal in response to detecting of the terminating signal.

17. The method as claimed in claim 16, wherein the detecting comprises:

monitoring a voltage level across the at least two of the second terminals; and determining an occurrence of the terminating signal when a voltage level exceeds a voltage threshold value.

18. The method as claimed in claim 16, wherein upon the termination of the supplying of the speaker signal, the method further comprises processing one or more input signals caused by distortions in the piezoelectric transducer layer.

19. The method as claimed in claim 18, wherein the processing comprises creating an audio signal from at least one of the input signals.

* * * * *